US008936244B2

(12) United States Patent
Bruce

(10) Patent No.: US 8,936,244 B2
(45) Date of Patent: Jan. 20, 2015

(54) DOCUMENT PINCHING

(75) Inventor: Joshua Bruce, Kitchener (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/331,495

(22) Filed: Dec. 20, 2011

(65) Prior Publication Data

US 2013/0154185 A1 Jun. 20, 2013

(51) Int. Cl.
*B65H 29/20* (2006.01)

(52) U.S. Cl.
USPC ..... 271/315

(58) Field of Classification Search
USPC ..... 271/315, 314, 207, 213, 214, 215, 217, 271/219, 187
See application file for complete search history.

(56) References Cited

U.S. PATENT DOCUMENTS 2,881,917 A * 4/1959 Brown et al. ..... 209/606
4,228,997 A * 10/1980 Schoonmaker et al. ..... 271/315
4,501,416 A * 2/1985 Hain ..... 271/3.01
4,718,655 A * 1/1988 Okayama et al. ..... 271/3.08
5,409,201 A * 4/1995 Kramer ..... 270/58.13
5,685,532 A * 11/1997 Amarakoon ..... 270/58.07
5,692,740 A * 12/1997 Holtje ..... 270/58.01

FOREIGN PATENT DOCUMENTS

JP 61-94936 * 5/1986
JP 61-267620 * 11/1986

* cited by examiner

*Primary Examiner* — Thomas Morrison
(74) *Attorney, Agent, or Firm* — Michael Chan

(57) ABSTRACT

An apparatus and method are disclosed for stacking items of media in a container region. The apparatus includes at least one rotatable element, each having an outer surface and an opposed claw element for releasably clamping an item of media to the outer surface of the rotatable element for rotation therewith. The apparatus also includes a driven roller element for locating an item of media released by the claw element into a stack position. The apparatus also includes a support platform element biased towards the roller element to compress items of media located in the stack position between the platform element and the roller element.

9 Claims, 7 Drawing Sheets

DOCUMENT PINCHING

FIELD OF THE INVENTION

The present invention relates to an apparatus and method for stacking items of media in a container. In particular, but not exclusively, the present invention relates to the storage of currency notes and/or cheques in a stacking bin of an automated teller machine (ATM).

BACKGROUND TO THE INVENTION

Media depositories are used to receive media items from a customer. One common type of media depository is a sheet media depository for receiving items of media in sheet form. For example, such items of media can be currency notes, cheques, tickets, giros or the like.

Sheet media depositories are used in automated teller machines (ATMs) and other self-service terminals. Other such self-service terminals are vending machines, change machines or the like. The sheet media depositories are used to identify, validate and store or return deposited sheets.

Some sheet depositories are capable of receiving a bunch of sheets in a loading area and then picking individual sheets from the bunch so that each sheet can then be identified and validated individually prior to storage of the validated sheet within a depository or returned to a customer. These depositories are sometimes referred to as bunch sheet depositories. Bunch sheet depositories may transport the bunch from a loading area to a picking area or the picking area may be adjacent to the loading area.

Bunches of items of media such as currency notes and/or cheques are thus deposited by a user and, subsequent to a user agreement step and item verification step, these items are stored semi-permanently within a self-service terminal until security staff or bank staff come to empty the storage unit. The storage unit is sometimes referred to as a stacking bin.

Prior known stacking bins in such self-service terminals include a rotating drum with an opposed claw which cooperate to locate items of media entering one-by-one onto an upper surface of a platform which acts as a movable floor of the stacking bin. However, there are a number of problems associated with such prior known stacking bin systems. Notably, the capacity for items is limited. Also, as the items of media are stacked on the platform, the documents fall one on top of each other in a haphazard manner. In particular, when the items include tears or ripples or curls or folds dead air pockets can appear in a document stack. This causes problems for users subsequently attending to removal of stored items when an access door is opened. Prior known storage container solutions also are relatively heavy and expensive to manufacture.

As an alternative to the stacking wheel approach noted above, and which as described leads to an uncompressed stack of items of media being created, another option which has been suggested is to provide a scissor arm plunger device in the stacking bin. This maintains a constant compression on the document stack when employed but cannot stack a continuous flow of documents. Instead, for each item of media which is introduced, the input cycle must be stopped whilst a scissor arm plunger is driven into the stack to create a compressive effect. Due to this, the plunger mechanism causes a bottleneck in the through-put of the system which thus does not permit a continuous flow.

SUMMARY OF THE INVENTION

It is an aim of the present invention to at least partly mitigate the above-mentioned problems.

It is an aim of certain embodiments of the present invention to provide a container region such as a region in a stacking bin and method for stacking items of media in such a region which is able to store items one-by-one bin whilst maintaining a compression on the items at all times.

It is an aim of certain embodiments of the present invention to provide an incremental drive stacking mechanism which uses a dual stacking wheel configuration and which has a continually biased platform to automatically and continually provide a compressive force on stacked items.

According to a first aspect of the present invention there is provided apparatus for stacking items of media in a container region, comprising:

- at least one rotatable element, each having an outer surface and an opposed claw element for releasably clamping an item of media to the outer surface of the rotatable element for rotation therewith;
- a driven roller element for locating an item of media released by the claw element into a stack position; and
- a support platform element biased towards the roller element to compress items of media located in the stack position between the platform element and the roller element.

Aptly, said support platform element and said driven roller element provide a constant pinch force on items of media in a stack of items of media arranged at the stack position.

Aptly, the apparatus further includes a spring element that constantly biases the platform element towards the roller element.

Aptly, the apparatus includes a drive shaft element to rotate each rotatable element, a Geneva crank pin element driven responsive to rotation of the drive shaft, and a Geneva wheel element driven by the crank pin, wherein said roller element is driven responsive to revolution of the Geneva wheel element.

Aptly, the Geneva wheel element is arranged to rotate as a leading edge of an incoming item of media reaches a pinch position between the platform element and the roller element.

Aptly, if the incoming item of media is a first item of media, the pinch position is located between an outer surface of the roller element and an opposed roller supported on the platform element, and if the incoming item of media is a non-first item of media, the pinch position is located between an outer surface of the roller element and an upper surface of an uppermost stacked item of media.

Aptly, rotation of the Geneva wheel element is arranged to cease as a leading edge of an incoming item of media moves laterally to a desired stack edge region.

Aptly, the Geneva wheel element comprises a major spur gear element comprising a plurality of major teeth elements and the apparatus further includes a drive wheel comprising a minor spur gear element comprising a plurality of minor teeth elements meshed with the major teeth elements, and a drive belt connecting the drive wheel to the roller element.

Aptly, a gear ration between the major spur gear element and the minor spur gear element is selected so that a rotation speed of the roller elements substantially matches a tangential speed of an item of media rotating with the rotatable element.

Aptly, the Geneva wheel element comprises a locking member that rotates with the Geneva wheel element and comprises plurality of locking abutment surfaces and the Geneva crank pin element is supported by a disc member that is driven by rotation of the drive shaft element, the disc member having a generally circular peripheral riding edge surface that rides against an opposed locking abutment surface wherein the riding edge of the disc member comprises at least one inset region which releases the locking member as the disc member rotates.

According to a second aspect of the present invention, there is provided an automated teller machine (ATM) comprising at least one rotatable element, each having an outer surface and an opposed claw element for releasably clamping an item of media to the outer surface of the rotatable element for rotation therewith;

a driven roller element for locating an item of media released by the claw element into a stack position; and a support platform element biased towards the roller element to compress items of media located in the stack position between the platform element and the roller element.

According to a third aspect of the present invention, there is provided a method of stacking items of media in a container region, comprising the steps of:

clamping an incoming item of media between a claw element and an outer surface of at least one rotatable element;

at least partially rotating the rotatable element;

unclamping the incoming item of media;

rotating a driven roller element to locate the unclamped incoming item of media into a stack position; and compressing one or more items of media located in the stack position between the roller element and a support platform element by urging the platform element towards the roller element.

Aptly, the method further comprises the steps of compressing the items of media by providing a constant pinch force between outer items of media in a stack of items of media by constantly biasing the platform towards the roller element via a spring element.

Aptly, the method further comprises stacking a continuous flow of incoming items of media one-by-one whilst constantly compressing an accumulating stack of items.

According to a fourth aspect of the present invention, there is provided a product which comprises a computer program comprising program instructions for:

clamping an incoming item of media between a claw element and an outer surface of at least one rotatable element;

at least partially rotating the rotatable element;

unclamping the incoming item of media;

rotating a driven roller element to locate the unclamped incoming item of media into a stack position; and compressing one or more items of media located in the stack position between the roller element and the support platform element by urging the platform element towards the roller element.

Certain embodiments of the present invention provide the advantage that items of media stored in a region of a container are continually compressed. This expunges air pockets from between documents. This helps maximise storage capacity as well as prevent overflow of documentation as a user opens a storage door to remove the deposited items.

Certain embodiments of the present invention provide the advantage that large bunches of items of media such as currency notes and/or cheques or the like may be processed in a continuous system and stored accordingly.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
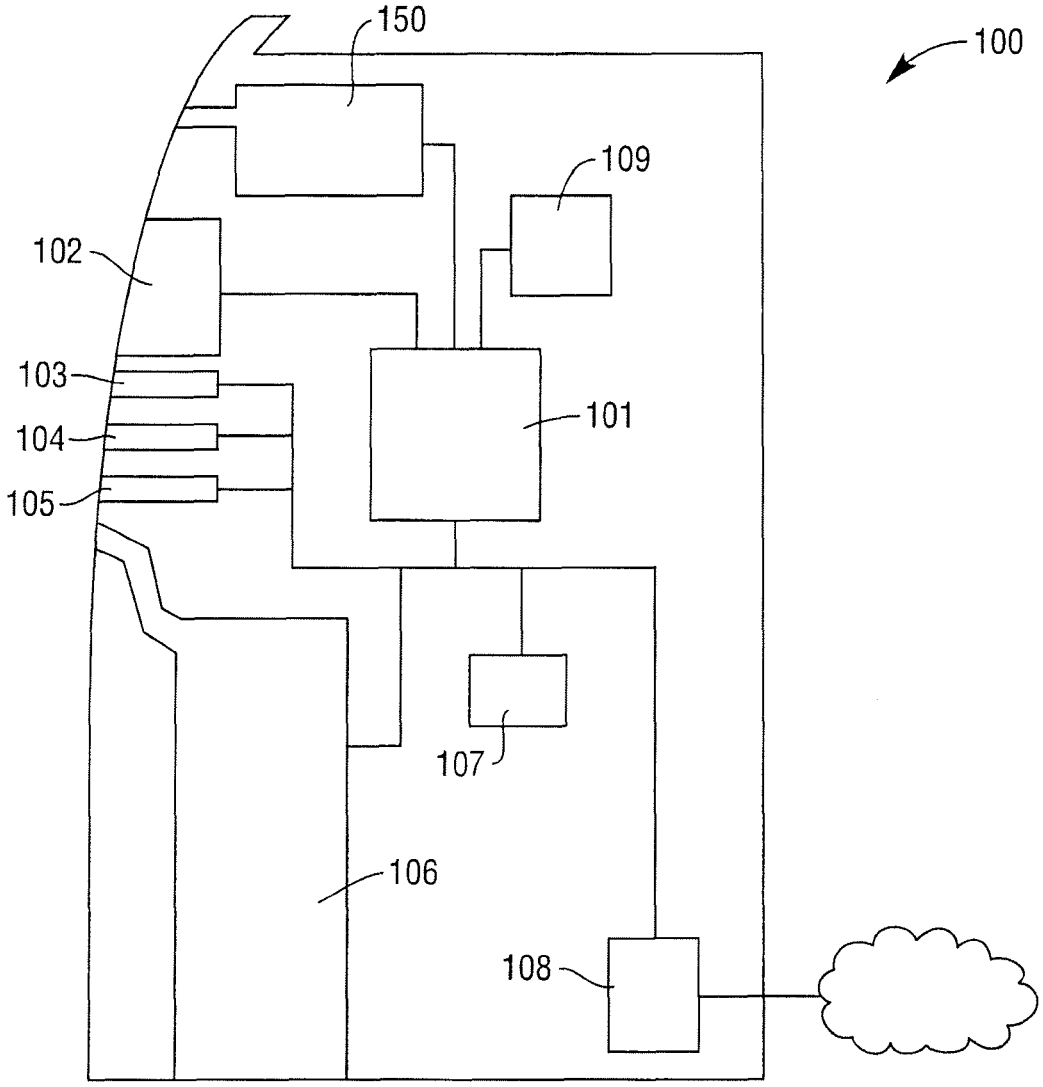
FIG. 1 is a schematic diagram of an ATM according to an embodiment of the present invention.

In the drawings like reference numerals refer to like parts.

FIG. 1 illustrates a block diagram of a self-service terminal 100 in the form of an automated teller machine (ATM) according to one embodiment of the present invention. It will be understood that certain embodiments of the present invention are applicable to other types of terminal such as ATMs, cash recyclers, teller units, vending machines, change machines and the like.

The ATM 100 includes different modules for enabling transactions to be executed and recorded by the ATM 100. These ATM modules include customer transaction modules and service personnel modules. The ATM modules include an ATM controller 101, a customer display 102, a card reader/writer module 103, an encrypting keypad module 104, a receipt printer module 105, a cash dispenser module 106, a journal printer module 107 for creating a record of every transaction executed by the ATM, a connection module 108, an operator panel module 109 for use by a service operator (such as a field engineer, a replenisher (of currency, of printed paper or the like), or the like).

Certain customer transaction modules (such as the ATM controller 101) are also used by the service personnel for implementing management functions. However, some of the modules are referred to herein as service personnel modules (such as the journal printer module 107 and the operator panel module 109) because they are never used by ATM customers.

FIG. 1 also illustrates a schematic diagram of a deposit module 150 according to one embodiment of the present invention. The deposit module 150 is operable to receive bunches of items of media such as currency notes, bank notes and/or cheques from a customer. These can be stored securely or returned to a customer.

Figure 2:
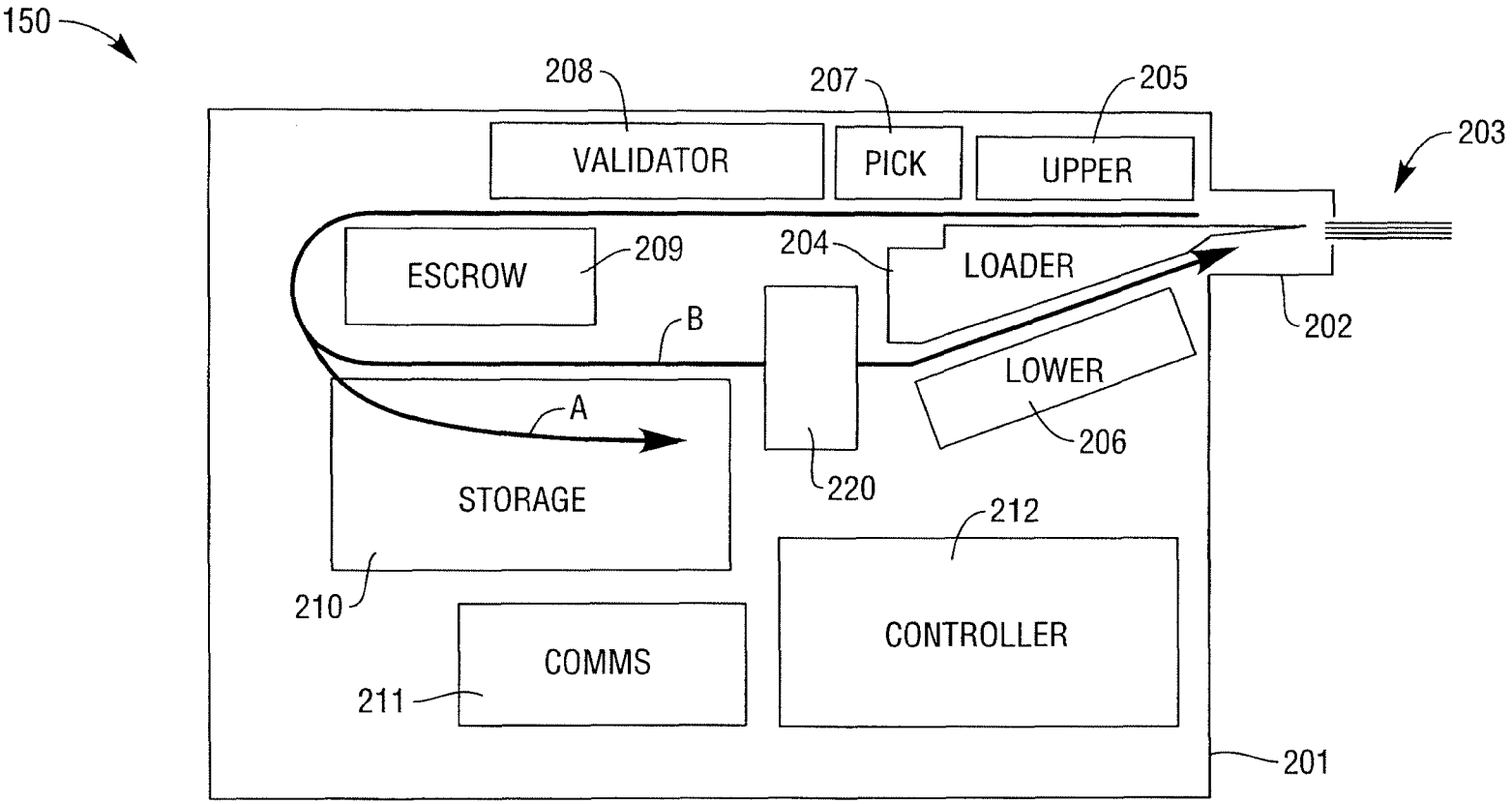
FIG. 2 is a schematic diagram of a depository according to an embodiment of the present invention.

The depository is shown in more detail in FIG. 2 and includes a chassis 201 onto which various parts are mounted. The depository 150 further includes a bunch deposit slot 202 at which a customer (not shown) can introduce a bunch 203 of currency notes or other such items of media. This enables the sheet items of media to be deposited by a customer. A bunch loader 204 co-operates with an upper loading unit 205 and a lower dispatch unit 206. These co-operate to receive the bunch of items of media and move them to a pick unit 207 or return them to a customer via slot 202 respectively. The pick unit 207 is aligned with the bunch loader 204 for removing individual sheets from the bunch of sheets 203. A sheet validator 208 determines whether the items of media are valid. An escrow 209 is provided for temporarily storing sheets until a customer confirms they wish to complete a transaction. A storage compartment 210 is provided as well as a communication circuit board 211 for communicating with the self-service terminal into which the depository 150 may be installed. An on-board controller 212 is provided for controlling the operation of the depository 150.

The depository 150 includes a plurality of transport units only some of which are described herein. An upper sheet transport section 205 is located above the bunch loader and adjacent to the picker 207. A lower sheet transport section 206 is located beneath the bunch loader 204 and near the bunch deposit slot 202.

The bunch loader 204 is used to transport deposited bank notes from the bunch deposit slot 202 to the pick unit 207.

There are two different routes that can be taken by an item of media that is inserted into the depository 150. A first route is shown by arrow A and involves the sheet item being picked from the bunch of sheets 203, transported to the picker unit 207, moved past the validator 208 to be identified and validated, placed in the escrow 209 and from the escrow 209 transported into the storage compartment 210.

The second optional route is shown by the arrow B and involves the sheet item being picked from the bunch of sheets 203, transported to the picker unit 207, moved past the validator 208 to be identified and validated, placed in the escrow 209 and from the escrow 209 returned to the customer via a rebunching unit 220 and via the loading unit 204 and lower transport section 206.

As will be understood by those skilled in the art, whether a sheet item is stored (that is to say, follows the route shown by arrow A) or returned to a customer (that is to say, follows a path shown by arrow B) depends on a number of factors, such as whether the sheet is recognised, whether a sheet is validated and/or whether a customer cancels or confirms a transaction or the like.

Figure 3:
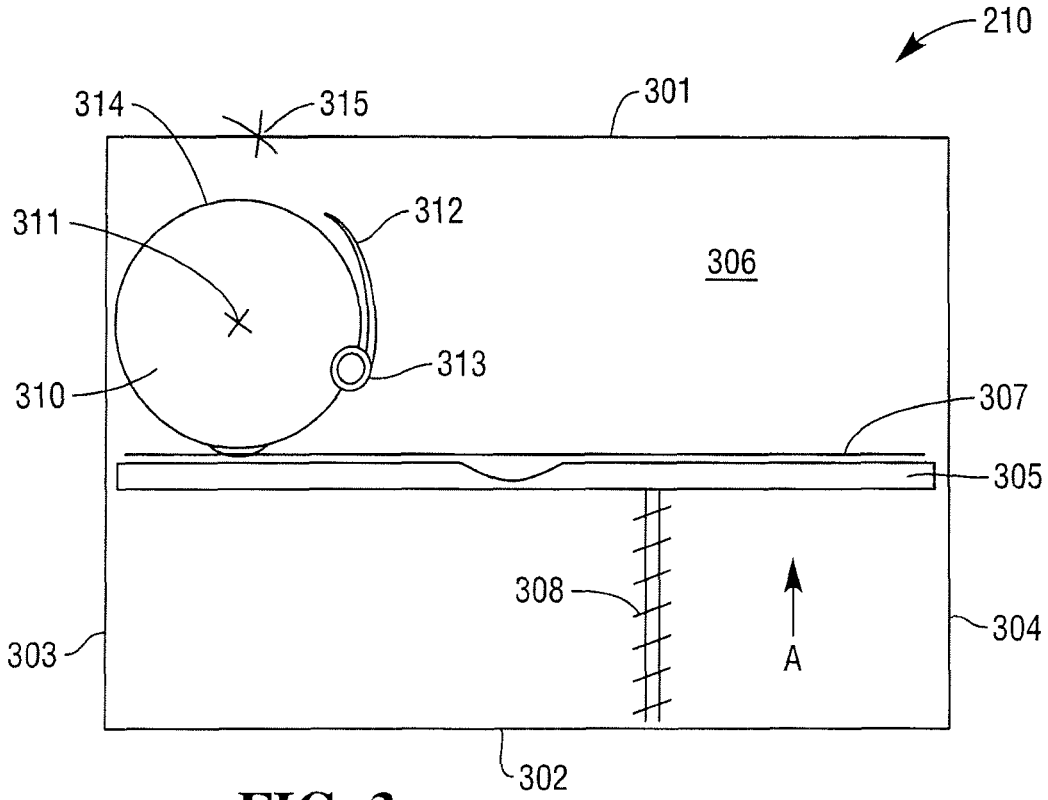
FIG. 3 illustrates a stacking wheel and claw with an incremental roller in a stacking bin.

FIG. 3 illustrates the storage compartment 210 in more detail. The storage compartment, which is sometimes referred to as a stacking bin, acts as a container to securely store on a semi-permanent basis items of media deposited by a user and which have been accepted for deposit. The container is effectively a box with rigid side walls having a top wall 301, a bottom wall 302, a first side wall 303 and an opposed spaced apart side wall 304. A platform 305 is a substantially rectangular plate element which effectively provides a floor to the container region 306 where items of media are subsequently to be stored in a stacked configuration. The platform has an upper surface 307 which is constantly urged upwards in the direction shown by arrow A in FIG. 3, by a spring 308 or some other such biasing element.

A stacking wheel 310 is provided which rotates about an axis of rotation 311. An opposed claw 312 pivots about a respective pivot point 313 so that the claw 312 may be driven against an outer surface 314 of the stacking wheel or withdrawn out of engagement. In the open mode of operation, items of media may be introduced between the claw and the outer surface of the stacking wheel to accept or release items therefrom. In a closed mode of operation the claw is closed against the outer surface thus securing an item of media therebetween. In such a closed mode of operation items of media such as currency notes or cheques are effectively clamped to the rotatable stacking wheel and thus move as the stacking wheel rotates. Items of media are introduced into the storage container region 306 via a slot 315 or other such opening in the container.

Figure 4:
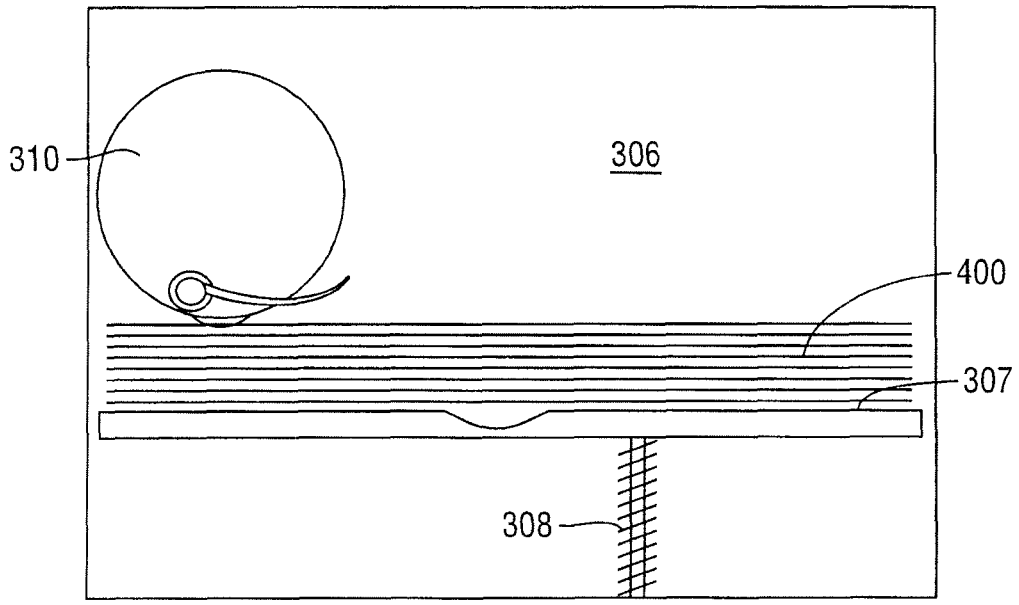
FIG. 4 illustrates multiple stacked items in a storage bin.

FIG. 4 illustrates the storage container in a full or partially full state in which the stacking wheel and claw have operated to receive items of media one-by-one through the input slot 315 and located the items of media one-by-one in a stacked configuration one on top of another on the upper surface 307 of the platform. As shown in FIG. 4, the items of media are stacked in a bunch between the upper surface of the platform and a lower surface of an incremental drive roller (described more fully herein below). When the bunch or stack of items reaches a certain height, this is determined by a sensor (not shown), and a signal may be sent to security personnel. They will then visit the ATM and open an access door (not shown) to provide security personnel with access to the inside of the container region. The stacked items may thus be removed. As will be described herein below in more detail, the stacking of items occurs in a very ordered fashion due to compressive forces which occur because the platform 305 is constantly urged upwardly against the stacking wheel and incremental drive roller. Also, because a roller used to help provide the compressive force carries out the dual role of locating an incoming item of media at a desired location. Thus, many items of media may be stored in a compact fashion and spillage of documents out of the open recess of the container is avoided when an access door is opened.

Figure 5:
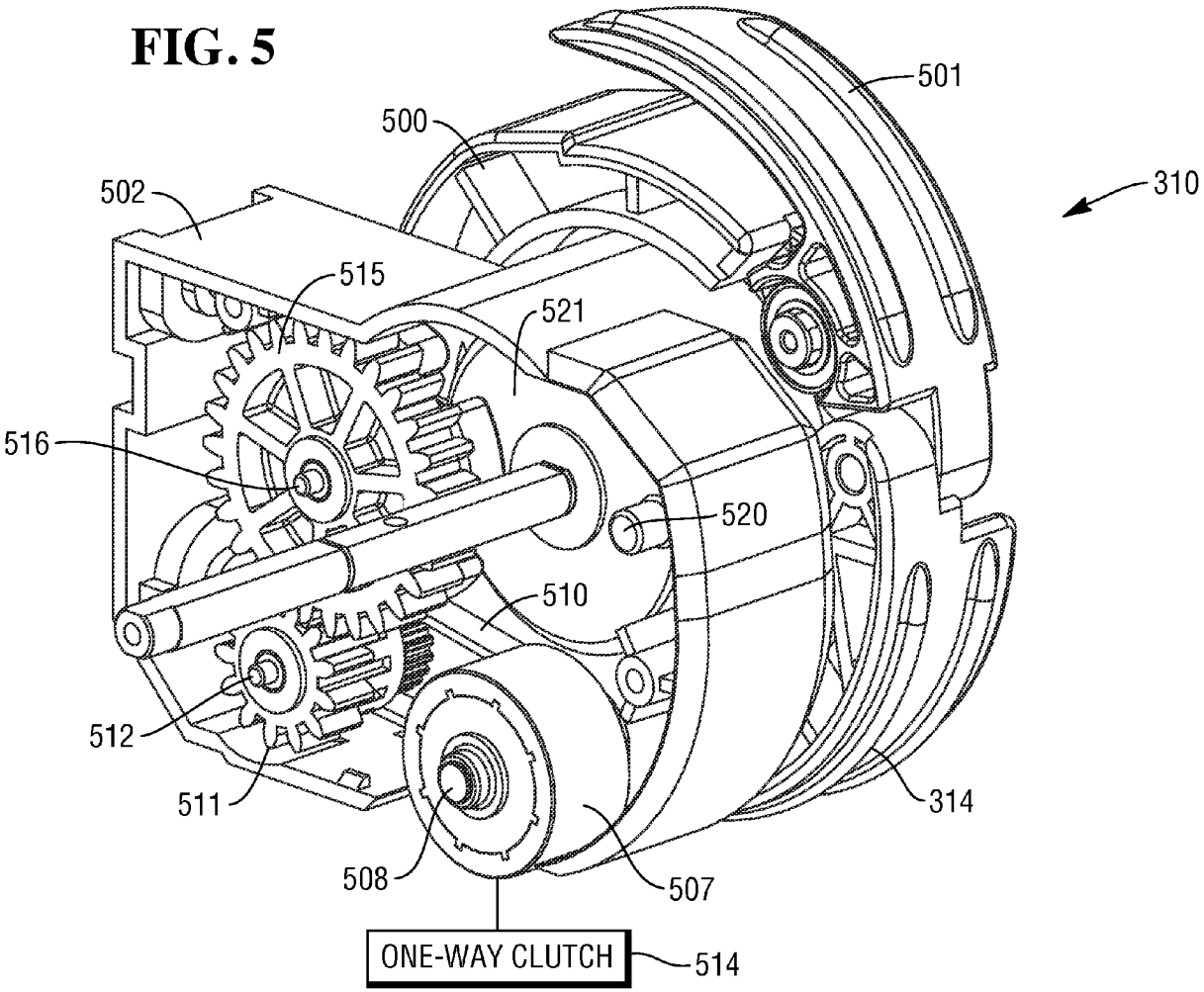
FIG. 5 illustrates a view of a stacking wheel.

FIG. 5 illustrates the stacking wheel 310 in more detail. In particular, the stacking wheel, as shown in FIGS. 5, 6, 7 and 8, itself includes two spaced apart and in parallel rotating wheels which act in unison and are driven by a common drive shaft. One stacking wheel 500 is illustrated in FIG. 5. Each stacking wheel 500 has a respective claw 501 which may be opened and closed to clamp incoming and outgoing items of media. Each stacking wheel 500 is a substantially circular wheel element, having an outer surface 314. The two spaced apart wheels 500 are spaced apart by a support housing 502. This support housing 502 is secured to a wall 303 of the stacking bin by self-tapping screws or other such suitable connectors such as nuts and bolts or the like. The housing 502 thus acts to support the stacking wheels at a desired position with respect to the container walls. The housing also contains various parts that assist in operation.

Also shown in FIG. 5 is an incremental drive roller 507 which has a circular outer contact surface and which rotates about a respective incremental drive roller axis 508. The drive roller 507 is driven by a belt 510 which is itself driven by rotation of a pulley/gear 511 which rotates about a common rotating axis 512. This pulley/gear is itself driven by rotation of a Geneva wheel 515 which rotates about an axis of rotation 516. The Geneva wheel 515 is described in more detail in respect of FIG. 6, however, it includes inlet slots which are driven selectively by a rotating drive pin 520 which itself is mounted on a drive disc 521. The drive disc 521 is driven by rotation of a shaft 530 which drives the two spaced apart drive wheels 500 as well as the drive disc 521.

Aptly, the incremental drive roller 507 is situated on a one-way clutch 514 that helps prevent ejecting documents out of the stack if the mechanism is driven backwards (which might happen during an integrity testing mode of operation to ensure the various components are orientated properly).

Figure 6:
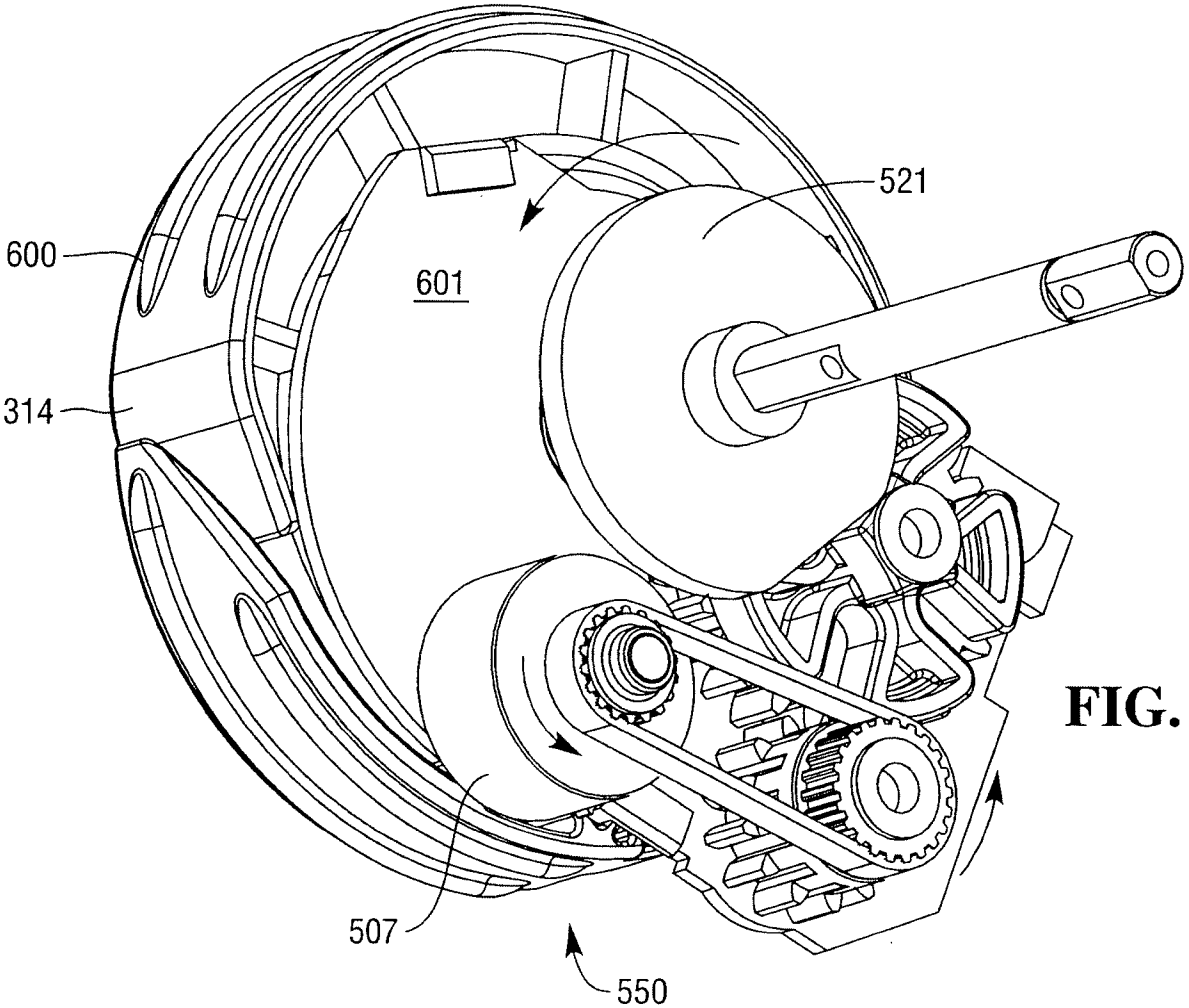
FIG. 6 illustrates another view of the wheel shown in FIG. 5.

FIG. 6 illustrates another view of part of the support housing 502 together with a further one of the stacking wheels 500. It is to be noted that the stacking wheel 500 shown in FIG. 6 is the wheel which is missing from FIG. 5. Likewise, the stacking wheel 500 shown in FIG. 5 is missing from FIG. 6. Likewise, the view of part of the support housing 502 shown in FIG. 6 is the view of the housing cap of the support housing 502. This closes the part of the housing shown in FIG. 5.

As shown in FIG. 6, the outer surface 314 of a stacking wheel may be provided with high friction ridges 600 to assist in the gripping and rotating motion as items of media are moved with a stacking wheel.

As illustrated in FIG. 6, a shaft 530 extends through both stacking wheels and the housing cap 601. This shaft is driven by a motor and gear system (not shown) to cause rotation of the stacking wheels, together with pre-selected rotation of the disc 521 which carries the drive pin 520. Thus, as the shaft rotates the disc 521 rotates and the single drive pin 520 rotates with it.

Eventually, the drive pin 520 (which extends into the page in FIG. 6) engages with one of five inlet slots on the inner surface of the Geneva wheel 515. When this occurs, circular rotation of the disc 521 is translated into a partial rotation of the Geneva wheel. This causes a reciprocal rotation of the pulley/gear which causes the incremental drive roller 507 to rotate a half revolution for every revolution of the stacking wheel input shaft. The slot number and gearing can of course be selected to synchronise turning with the timing of incoming items.

In use the platform is constantly urged upwards by a biasing element such as a spring or motor or scissor action element or the like. When no items of media are stored in the container, then an upper surface of the platform is constantly urged against an outer surface of the incremental roller 507 at a pinch point location 550. As items of media are input one-by-one at the inlet opening, these are clamped to a stacking wheel which then rotates a partial revolution towards a position in which the claw is towards the bottom of the container region. At this moment in time the claw is timed to open to release an item of media. The rotation is timed, together with manufacture and design of the Geneva wheel system, so that at this point in time the incremental roller turns to duly locate the incoming item of media towards the side wall 303 shown in FIG. 3. The timing of the rotation of the incremental roller locates an edge of an item of media at a desired location. Items of media are thus stacked one-by-one with a constant compressive force being provided between the incremental roller and the upwardly pressed platform. This constant and automatically generated compression helps avoid gaps between stacked items of media and also helps maintain a stack in a neat configuration.

Figure 7:
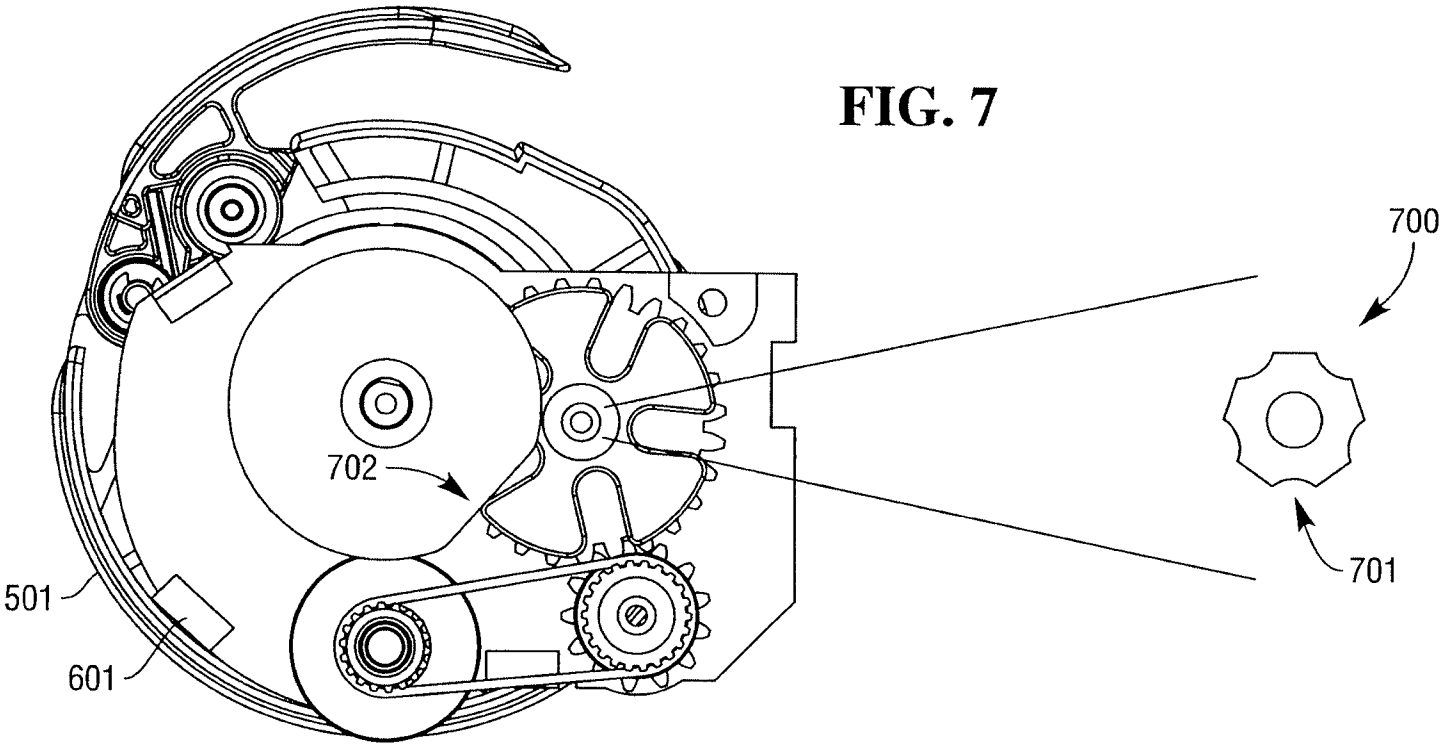
FIG. 7 illustrates a locking mechanism that prevents undesired rotation of a Geneva wheel.

FIG. 7 illustrates another view similar to that shown in FIG. 6 in which a locking element 700 on the Geneva wheel can be seen in more detail. The locking element is an upwardly extending stud, having arcuate abutment surfaces. Five such arcuate abutment surfaces 701 are shown in FIG. 7. The number of abutment surfaces matches a number of inlet drive slots in the Geneva wheel. As the drive disc 521 rotates, a generally circular curved outer edge of the drive disc is urged against a one respective curved locking surface 701. The disc includes a cut out region 702. As the disc rotates this cut out region eventually rotates to be face to face with the locking element 700. At this moment in time, the locking element is released from riding on the outer surface of the disc. At this moment in time, the Geneva wheel is thus able to rotate. This is timed with rotation of the drive pin 520 and the Geneva wheel inlets slots. As the disc 521 continues to rotate, the cut out region eventually moves beyond the locking element which again brings a curved outer edge of the disc into location with a respective one of the abutment surfaces of the locking nut, thus preventing further rotation until the cut out region 702 completes a further rotation.

Figure 8:
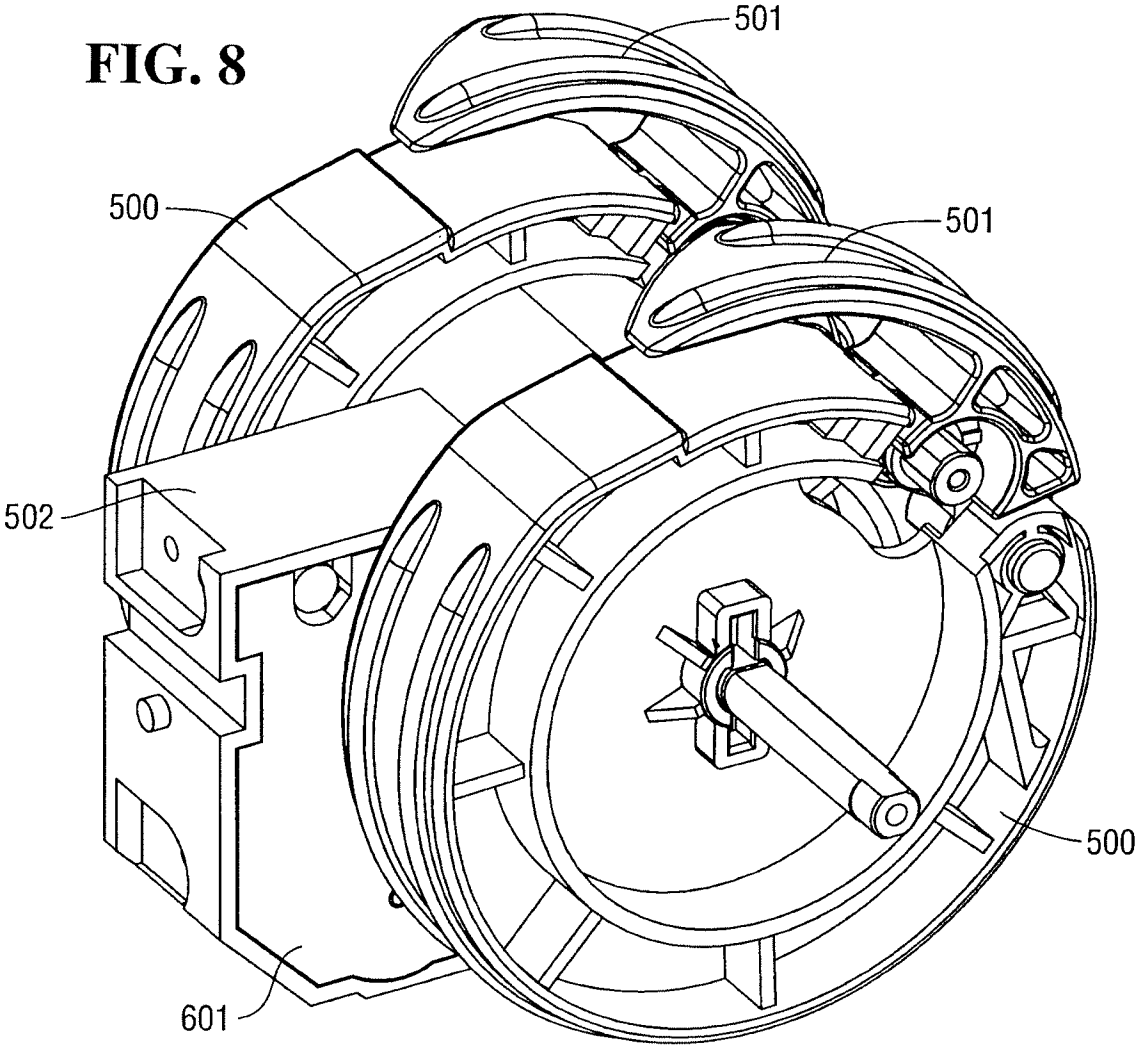
FIG. 8 illustrates stacking wheels on either side of a housing.

FIG. 8 helps illustrate how the two spaced apart stacking wheels are located on either side of a housing 502 which is closed by a housing cap 601. The housing and housing cap thus form a storage mechanism having a chamber in which the various gears and belts previously described are located and stored. The cap is secured in place with respect to the remainder of the housing and then the whole combination may be secured to a surrounding wall to support the stacking wheels in a desired location.

Certain embodiments of the present invention thus provide a higher capacity than prior known stacking mechanisms. Also, certain embodiments of the present invention prevent document avalanches on opening a stacking bin door. Certain embodiments of the present invention are mechanically timed from a stacking wheel shaft. As a stacking wheel shaft rotates to rotate one or more stacking wheels to add a document to a stack, a Geneva wheel operates an incremental drive. This drive activates as a leading edge of a document reaches a pinch point creating a pinch point created by the incremental drive roller and the document stack. When the incremental drive roller turns the incoming document is driven into the stack, stopping before the document actually reaches an end wall which would otherwise cause crumpling. This allows a continuous flow of documents into the stack, whilst maintaining compression on the stack throughout operation.

Certain embodiments of the present invention provide a mechanical timing mechanism using a five-stage Geneva wheel and a belt and gear system to achieve a desired gear reduction so as to match a tangential speed of incoming documents at the incremental drive roller. Also, an anti-rotation feature may optionally be included to help ensure that the mechanism never loses timing.

Certain embodiments of the present invention provide a high capacity of documents in stacking bins relative to prior known devices. This is achieved by compressing the stack. This also has a stabilising effect so that the stack does not buckle or topple when an access door is opened. Cost and mass are also much reduced relative to prior known devices since the motor, gear box and clutch used to control the platform in prior known devices are not required.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for stacking items of media in a container having a bottom wall surface, comprising:

at least one rotatable element, each having an outer surface and an opposed claw element for releasably clamping an item of media to the outer surface of the at least one rotatable element for rotation therewith;

a driven roller element for locating an item of media released by the claw element into a stack position;

a one-way clutch operatively coupled to the roller element to prevent the roller element from being driven in a backward direction;

a support platform element having a bottom surface facing the bottom wall surface of the container and a top surface facing the roller element and onto which items of media can be stacked; and a spring element disposed between the bottom surface of the support platform element and the bottom wall surface of the container to provide a biasing force which biases the support platform element towards the roller element, wherein the biasing force of the spring element constantly biases the support platform element toward the roller element to provide constant compression of items of media between the roller element and the top surface of the support platform element as unstacked items of media are being located in the stack position on the top surface of the support platform element.

2. An automated teller machine (AIM) comprising a deposit module, comprising apparatus as claimed in claim 1, wherein each item of media comprises a currency note and/or cheque.

3. Apparatus for stacking items of media in a container region, comprising:

at least one rotatable element, each having an outer surface and an opposed claw element for releasably clamping an item of media to the outer surface of the at least one rotatable element for rotation therewith;

a driven roller element for locating an item of media released by the claw element into a stack position;

a support platform element biased towards the roller element to constantly compress already stacked items of media between the support platform element and the roller element while unstacked items of media are being located in the stack position;

a drive shaft element to rotate each at least one rotatable element;

a Geneva crank pin element driven responsive to rotation of the drive shaft element; and a Geneva wheel element driven by the Geneva crank pin element;

wherein the roller element is driven responsive to revolution of the Geneva wheel element.

4. The apparatus as claimed in claim 3, further comprising:

the Geneva wheel element is arranged to rotate as a leading edge of an incoming item of media reaches a pinch position between the support platform element and the roller element.

5. The apparatus as claimed in claim 4, further comprising:

if the incoming item of media is a first item of media, the pinch position is located between an outer surface of the roller element and the support platform element; and if the incoming item of media is a non-first item of media, the pinch position is located between an outer surface of the roller element and an upper surface of an uppermost stacked item of media.

6. The apparatus as claimed in claim 3, wherein the Geneva wheel element comprises a major spur gear element comprising a plurality of major teeth elements, the apparatus further comprising:

a drive wheel comprising a minor spur gear element comprising a plurality of minor teeth elements meshed with the major teeth elements; and a drive belt connecting the drive wheel to the roller element.

7. The apparatus as claimed in claim 6, further comprising:

a gear ratio between the major spur gear element and the minor spur gear element is selected so that a rotation speed of the roller element substantially matches a tangential speed of an item of media rotating with the at least one rotatable element.

8. The apparatus as claimed in claim 3, further comprising:

the Geneva wheel element comprises a locking member, that rotates with the Geneva wheel element and comprises plurality of locking abutment surfaces; and the Geneva crank pin element is supported by a disc member that is driven by rotation of the drive shaft element, the disc member having a generally circular peripheral riding edge surface that rides against an opposed locking abutment surface;

wherein the riding edge of the disc member comprises at least one inset region which releases the locking member as the disc member rotates.

9. An automated teller machine (AIM) comprising a deposit module, comprising apparatus as claimed in claim 3, wherein each item of media comprises a currency note and/or cheque.

* * * * *